United States Patent [19]

Coyle et al.

[11] 4,452,560

[45] Jun. 5, 1984

[54] QUICK COUPLER ASSEMBLY

[75] Inventors: Edward L. Coyle; Herman J. Maurer; Gary L. Cochran, all of Burlington, Iowa

[73] Assignee: J. I. Case Company, Racine, Wis.

[21] Appl. No.: 385,584

[22] Filed: Jun. 7, 1982

[51] Int. Cl.[3] ..... E02F 3/81

[52] U.S. Cl. ..... 414/723; 172/273

[58] Field of Search ..... 414/723; 172/272-275; 37/117.5, 118 R, 118 A

[56] References Cited

U.S. PATENT DOCUMENTS 4,119,225 10/1978 Macht et al. ..... 414/723

*Primary Examiner*—Robert J. Spar
*Assistant Examiner*—Donald W. Underwood
*Attorney, Agent, or Firm*—Cullen, Sloman, Cantor, Grauer, Scott & Rutherford

[57] ABSTRACT

A quick coupler assembly for attaching a material handling bucket or the like to the free ends of lift arms extending from a loader. The quick coupler assembly includes an elongated cross member having hitch brackets on its opposite ends. Each hitch bracket includes an end which is received within a socket coupling member on the rear wall of the bucket near the top edge thereof. The opposite end of the hitch bracket is configured for engagement within a lower coupling member on the bucket rear wall. The coupler assembly further includes an attaching lever which is rotatably secured to the backside of the cross member substantially at its midportion. The lower end of the attaching lever is movable into engagement within a coupling member on the rear wall of the bucket. The upper end of the attaching lever includes a slidable or rotatable locking bracket assembly which is selectively moved into locking engagement with a locking member on the bucket rear wall. A tilt cylinder preloads the bucket against the quick coupler assembly such that the only force required from the operator is a simple manual movement of the locking bucket assembly into a position for final coupling.

5 Claims, 14 Drawing Figures

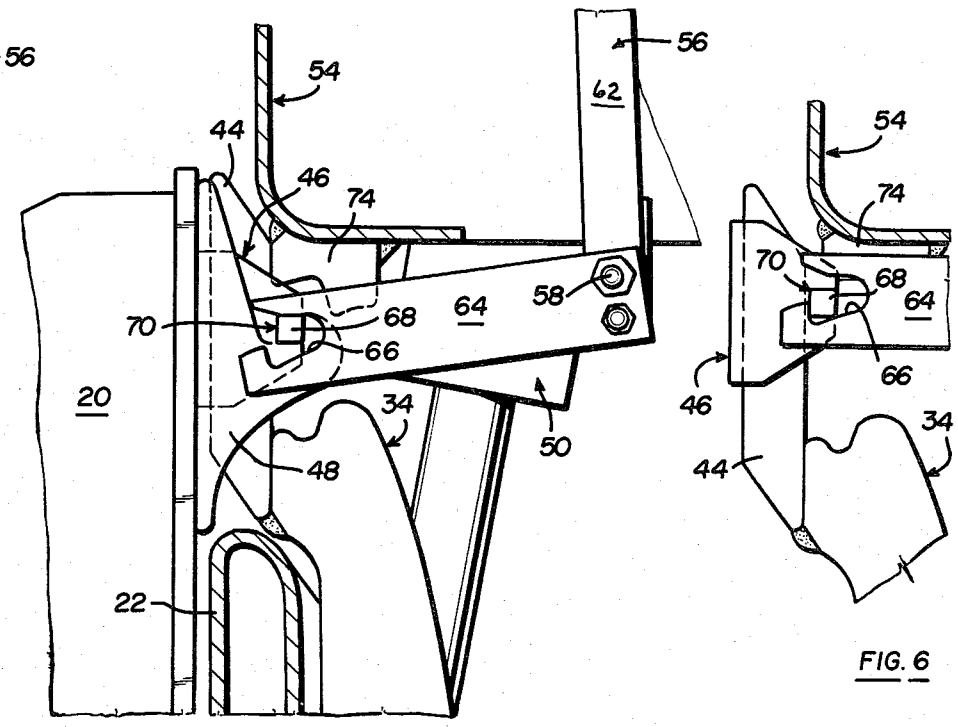
FIG. 6
FIG. 5
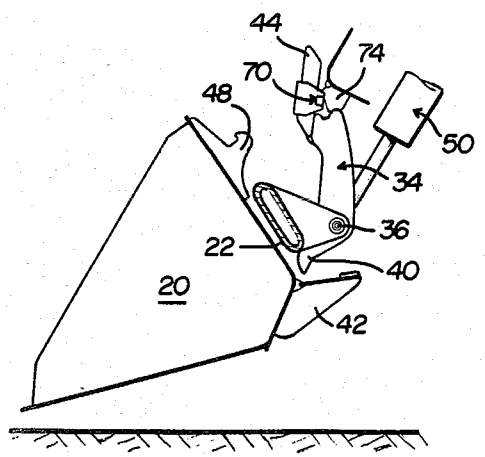
FIG. 9
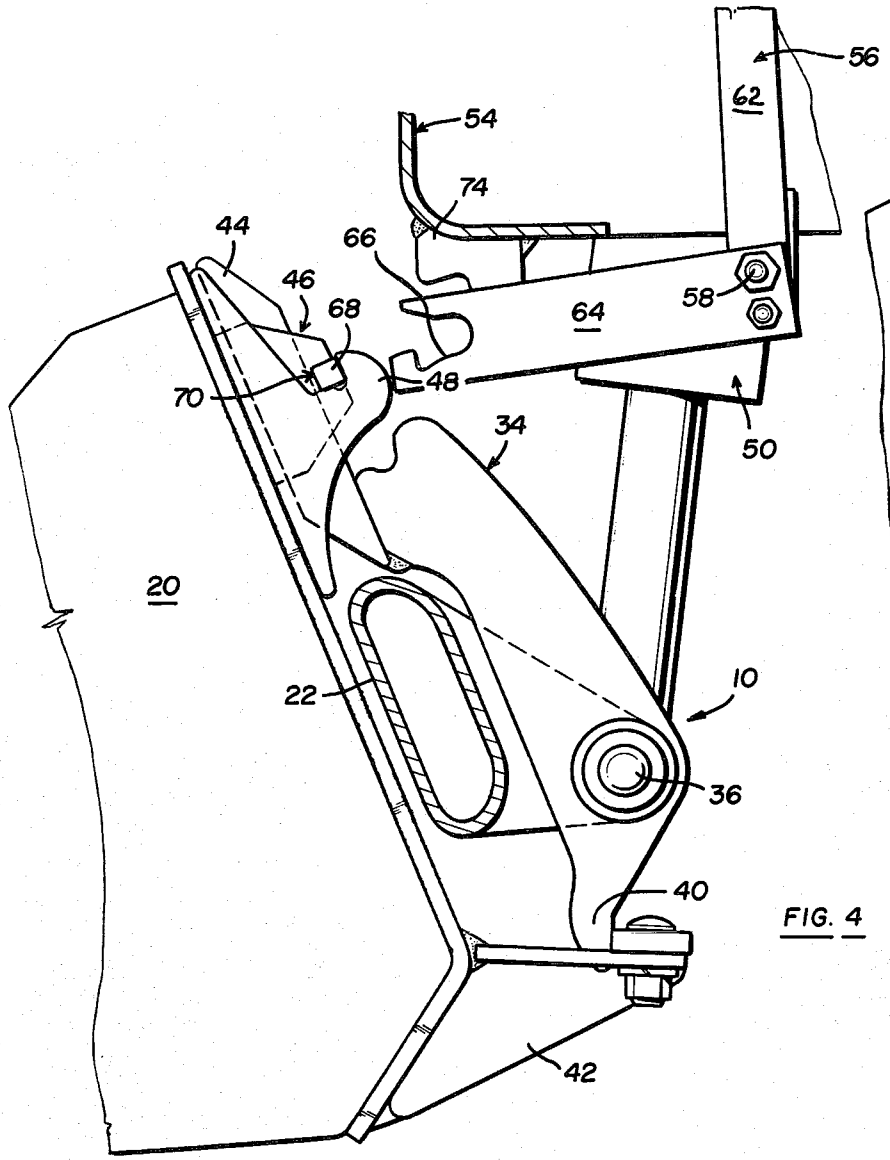
FIG. 4

QUICK COUPLER ASSEMBLY

BACKGROUND OF THE INVENTION

The present invention relates to an apparatus for attaching implements to the free end of a tractor loader boom, and more particularly, to an improved quick coupler assembly for attaching buckets or the like to tractor lift arms.

It is known to provide earth-working machines such as front end loaders with different sizes and types of material handling implements or buckets to perform numerous working operations. Changing from one bucket to another is a problem because of the time and labor expanded in the changeover. The buckets are heavy and awkward to manipulate and many times special tools are required to make the changeover. It is an object of this invention to provide a quick coupling assembly for easily coupling and releasing different buckets to the same tractor lift arms.

The prior art is already aware of various arrangements for quickly attaching implements or the like to tractors. These devices exist in various complex forms and some of them require that the attaching pieces be accurately and carefully aligned and then the operator must maneuver a fastening or securing member in order to complete the attachment. Some of the prior art devices even require that the operator leaves his seat in order to maneuver parts included in the attachment device to complete the attaching. Accordingly, it is a general object of the present invention to improve upon the prior art quick attachment devices and specifically to do so with a device which is simple but sturdy in construction and therefore is reliable in its operation and in its strength in supporting a lifting implement such as a loader bucket or the like.

More specifically, there has been a need for a quick attachment device which permits ready and easy attachment and detachment of an implement without requiring that the operator leave his seat for achieving the attaching. Further, there has been a need for a quick attachment device which is arranged to have the lifting implement disposed at its closest possible location relative to the extending ends of the tractor lifting arms so that there is only a minimal over-balance from the lifting implement acting on the lifting arms.

The disadvantages of prior art quick attaching mechanisms have resulted in the present quick coupling assembly which is compact from the point of attachment with the tractor lift arms to the implement itself.

SUMMARY OF THE INVENTION

In accordance with the present invention, the improved quick coupler assembly permits various buckets to be used with the same tractor lift arms, and it permits a bucket to be attached or released from the tractor lift arms without the operator leaving his seat. Further, the force required to attach the bucket to the quick coupler assembly is provided by the hydraulic actuator which tilts the bucket.

The quick coupler assembly includes an elongated cross member having hitch brackets on its opposite ends. Each hitch bracket includes an upper end which is received within a socket coupling member on the rear wall of the bucket near the top edge thereof. The opposite end of the hitch bracket is configured for engagement within a lower coupling member on the bucket rear wall. The coupler assembly further includes an attaching lever which is rotatably secured to the backside of the cross member substantially at its mid-portion. The lower end of the attaching lever is movable into locking engagement with a coupling member on the rear wall of the bucket.

In a first embodiment, the upper end of the attaching lever includes a slidable locking bracket assembly which is selectively movable into locking engagement with locking hooks on the bucket rear wall. Alternatively, the upper end of the attaching lever includes a rotatable locking bracket assembly which is selectively rotated into locking engagement with a locking hook on the bucket rear wall.

A tilt cylinder for rotating the quick coupler assembly and bucket is pivotally attached at its rod end to the quick coupler cross member. The opposite end of the cylinder is secured to a cross tube frame which extends between and connects the tractor loader arms. A manually operable lock lever is pivotally attached to a bracket extending from the cross tube frame. The lock lever includes a handle portion at one end and at least one leg having a lock pin receiving portion for capturing the outer terminal end of a lock pin on either the slidable or rotatable locking bracket assembly. The lock lever is manually movable to opposite sides of a handle stop during the coupling and uncoupling process.

To begin the coupling process, the operator retracts the tilt cylinder, thereby causing the hitch brackets to pivot forwardly and downwardly towards the bucket so that the operator can maneuver the tractor and engage the upper ends of the hitch brackets within the socket coupling members on the bucket rear wall. Raising the loader lift arms and extending the bucket tilt cylinder results in the lifting of the bucket off the ground until the lower ends of the hitch brackets engage the lower coupling members on the bucket rear wall. In this position, the bucket is hanging on the quick coupler assembly without being locked thereto.

During the initial maneuvering of the bucket for the coupling process, the attaching lever is held near a stop member on the cross tube frame. This is accomplished by holding the outer end of the lock pin within the pin receiving portion of the lock lever leg with the lock lever handle portion being positioned on one side of the handle stop. The attaching lever is held in this position until the bucket is rotated rearwardly by the tilt cylinder thereby pushing the attaching lever back against the stop member on the cross tube frame.

After the operator has maneuvered the bucket into a hanging position on the quick coupler hitch brackets, the tilt cylinder is further extended to rotate the bucket rearwardly toward the stop member on the cross tube frame and against the attaching lever. The upper end of the attaching lever is pushed against the stop member and the lower end of the attaching lever is seated in its coupling member in response to rearward rotation of the bucket. Thus, the bucket tilt cylinder preloads the bucket against the quick coupler assembly and the only force required from the operator is a simple manual movement of the locking bracket assembly into position for final coupling.

The lock pin of the locking bracket assembly is rotated or slid into a final seated or locked position within the locking hook on the bucket rear wall by moving the handle portion of the lock lever to the opposite side of the handle stop which also permits the attaching lever to move away from the lock lever without interference.

Then, the bucket is coupled to the quick coupler assembly and may be rotated to any desired position by extending or retracting the tilt cylinder.

The bucket is uncoupled from the quick coupler assembly by performing the coupling steps in reverse. The bucket is rotated rearwardly until the upper end of the attaching lever engages the stop member and the outer terminal end of the lock pin moves into the pin receiving portion on the lock lever. The operator then rotates the lock lever handle portion to the opposite side of the handle stop which causes upward sliding movement or rotation of the locking bracket assembly and lock pin on the upper end of the attaching lever thereby unlocking the attaching lever from the bucket. The bucket is then left hanging on the hitch brackets as previously described for easy uncoupling and the locking bracket assembly is held near the stop member by the lock lever.

Thus, the quick coupler assembly of the present invention permits an operator to couple or uncouple a bucket without leaving his seat. The force for attaching and preloading the bucket to the coupler assembly is provided by the bucket tilt cylinder rather than the operator providing the latching force on a loose, heavy, unpreloaded bucket as is required with prior art devices. Further, the latching is accomplished at a single latching point on the bucket using a slidable or rotatable mechanical latching means without requiring auxiliary hydraulic or electrical power tools.

Other advantages and meritorious features of the quick coupler assembly of the present invention will be more fully understood from the following detailed description of the invention, the appended claims, and the drawings, a brief description of which follows.

BRIEF DESCRIPTION OF DRAWINGS

FIG. 4 is a fragmentary side elevational view of the quick coupler assembly taken near its mid portion.

FIG. 5 is a fragmentary side elevational view illustrating one type of latching mechanism for the quick coupler assembly.

FIG. 6 is a fragmentary side elevational view illustrating the slidable locking bracket assembly on the attaching lever.

FIG. 9 is a side elevational detail near the mid-portion of the quick coupler assembly illustrating the attaching lever in its unlocked condition.

DETAILED DESCRIPTION OF THE INVENTION

An earth-working machine including the quick coupler assembly made in accordance with the teachings of the present invention is illustrated in FIGS. 1–9. A second embodiment of the quick coupler assembly is illustrated in FIGS. 10–14, but it differs from the first embodiment only in the type of latching mechanism used.

Figure 1:
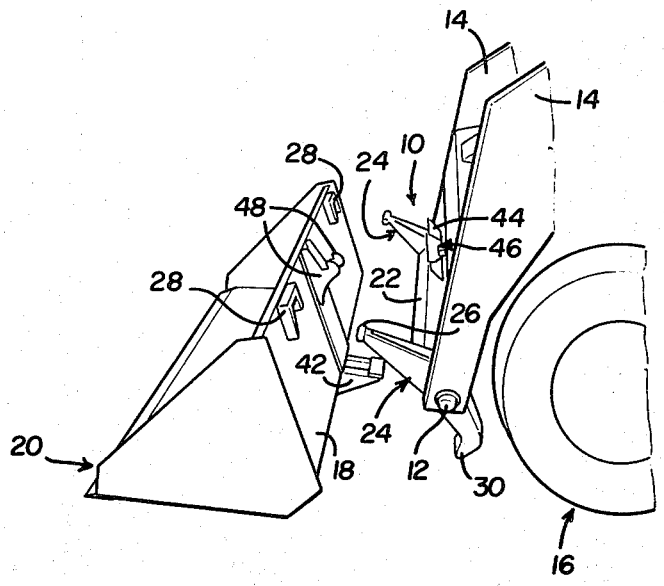
FIG. 1 is a perspective view of a bucket and the quick coupler assembly of the present invention including a first embodiment of the latching mechanism.

The general nature of the present invention may be understood with reference to FIG. 1. The quick coupler assembly 10 is pivotally connected by pins 12 between the free ends of loader arms 14 on front end loader 16. Quick coupler assembly 10 may be releasably secured to the rear wall 18 of bucket 20 without the operator leaving his seat to complete the attaching. Bucket 20 may also be uncoupled from coupler assembly 10 without the operator leaving his seat.

The quick coupler assembly 10 includes an elongated, cross member 22 having hitch brackets 24 on its opposite ends. Each hitch bracket 24 includes an end 26 which is received within a socket coupling member 28 on the rear wall 18 of bucket 20 near the top edge thereof. The opposite end 30 of bracket 24 is configured for engagement within a lower coupling member 32 on bucket rear wall 18. Coupler assembly 10 further includes an attaching lever 34 (FIG. 9) which is pivotally secured by pin 36 and lugs 38 (FIG. 2) to the backside of cross member 22 substantially at its mid-portion. The lower end 40 of attaching lever 34 is movable into engagement within coupling member 42 on the rear wall 18 of bucket 20.

In the first embodiment, as illustrated in FIGS. 1–9, the upper end 44 of attaching lever 34 includes a slidable locking bracket assembly 46 which is selectively moved into locking engagement with locking hooks 48 on bucket rear wall 18.

A tilt cylinder 50 for rotating quick coupler 10 and bucket 20 is pivotally attached by pin 36 at its rod end between lugs 38 on cross member 22. The opposite end of cylinder 50 is secured by pin 52 to cross tube frame 54 which extends between and connects loader arms 14. Manually operable lock lever 56 is pivotally attached by pin 58 to a bracket extending from cross tube frame 54. Lock lever 56 includes a handle portion 62 at one end and a pair of spaced apart, parallel legs 64 (only one being shown) having lock pin receiving portions 66 for capturing the opposite ends 68 of lock pin 70 (FIG. 2) on locking bracket assembly 46. Legs 64 are widely spaced apart (not shown) to engage the outer terminal ends 68 of lock pin 70 without interfering with locking hooks 48. Lock lever 56 is movable to opposite sides of handle stop 72 (FIG. 3) during the coupling and uncoupling operation as will be described.

Figure 7:
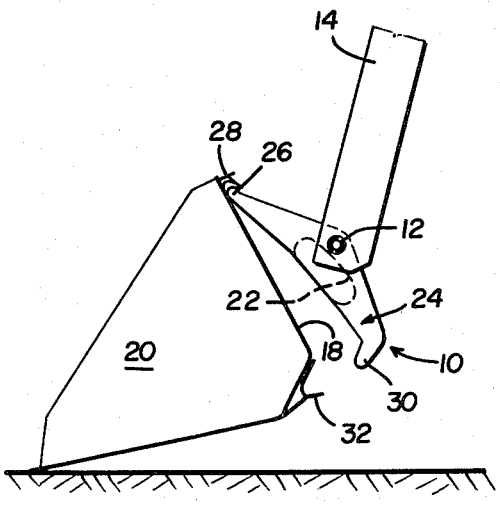
FIG. 7 is a side elevational detail showing the movement of the hitch brackets to begin the coupling process.
Figure 8:
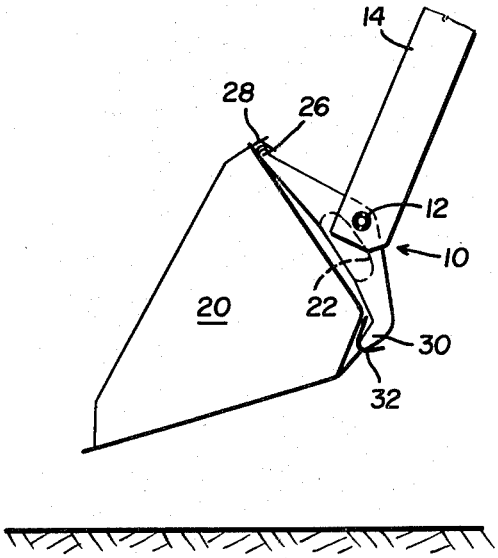
FIG. 8 is a side elevational detail illustrating the bucket hanging on the quick coupler assembly without being locked thereto.

The operation of quick coupler 10 will be described by first referring to FIGS 1, 7 and 8. FIG. 1 illustrates bucket 20 uncoupled from quick coupler 10. To begin the coupling process, the operator retracts cylinder 50 thereby causing hitch brackets 24 to pivot forwardly and downwardly towards bucket 20 so that the tractor can be maneuvered to engage the upper ends 26 of brackets 24 into the socket coupling members 28 on bucket rear wall 18, as illustrated in FIG. 7. Referring to FIG. 8, the operator then raises lift arms 14 and extends tilt cylinder 50 until the lower ends 30 of brackets 24 engage lower coupling members 32 on bucket rear wall 18. In the position illustrated in FIG. 8, bucket 20 is hanging on quick coupler 10 without being locked thereto.

FIG. 9 is a sectional view substantially at the center of bucket 20 illustrating the position of attaching lever 34 and lock pin 70 when bucket 20 is in the unlocked position of FIG. 8. During the initial maneuvering of bucket 20 for the coupling process, attaching lever 34 is held near stop member 74 on cross tube frame 54. This is accomplished, as shown in FIG. 6, by holding the outer ends 68 of lock pin 70 within receiving portions 66 of lock lever legs 64 with lock lever handle portion 62 being positioned on the right side of handle stop 72 as viewed in FIG. 3. Attaching lever 34 is held in the position shown in FIG. 9 until bucket 20 is rotated rearwardly by tilt cylinder 50 thereby pushing attaching lever 34 back against stop member 74.

After the operator has located bucket 20 in the hanging position of FIG. 8, tilt cylinder 50 is extended to rotate bucket 20 rearwardly toward stop member 74 and against attaching lever 34. The upper end 44 of attaching lever 34 is pushed against stop member 74 and the lower end 40 of attaching lever 34 is seated in coupling member 42 in response to rearward rotation of bucket 20. Thus, tilt cylinder 50 preloads bucket 20 against quick coupler assembly 10 and the only force required from the operator is a simple manual movement of lock pin 70 into position for final coupling.

Figure 3:
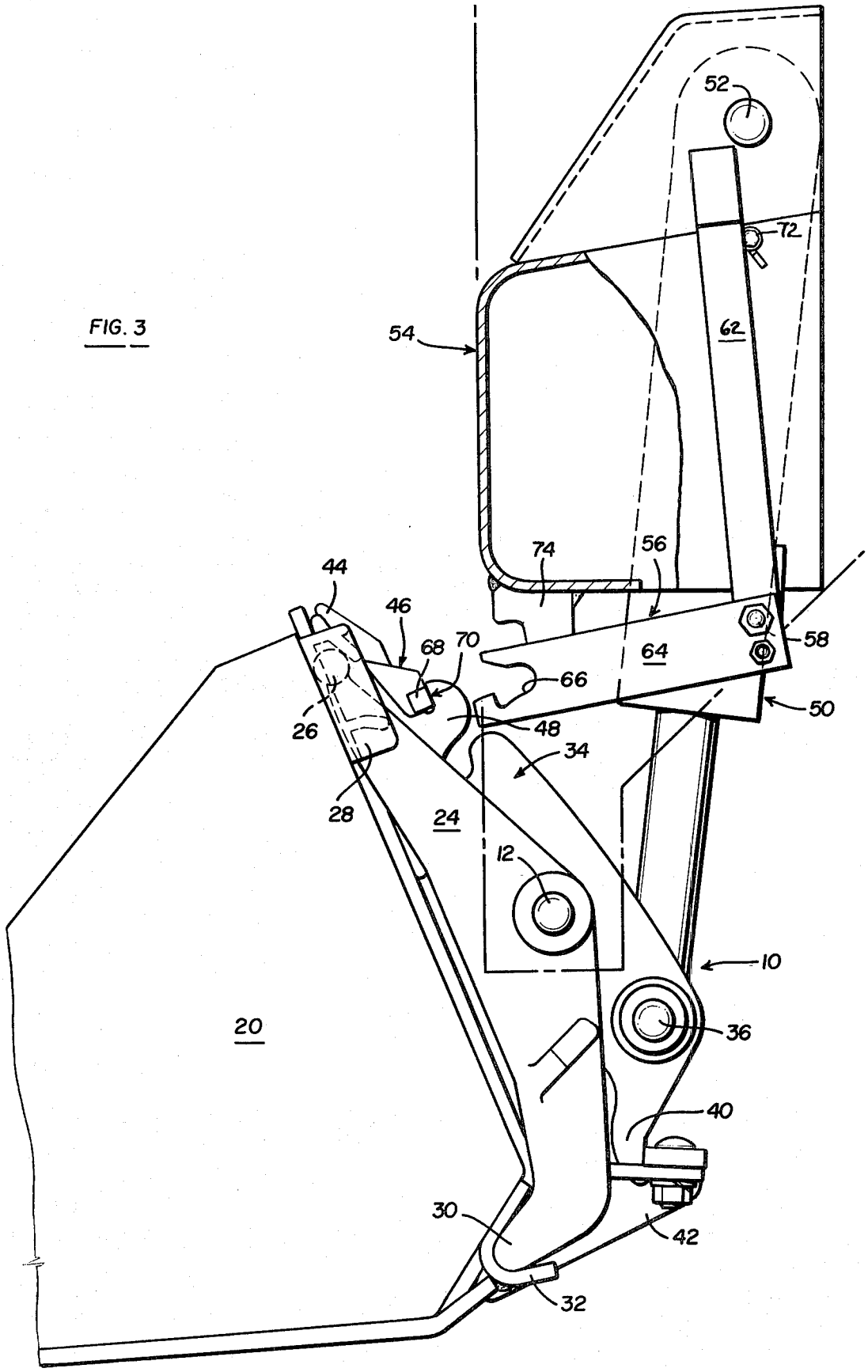
FIG. 3 is a cross-sectional view taken along line 3—3 in FIG. 2.
Figure 10:
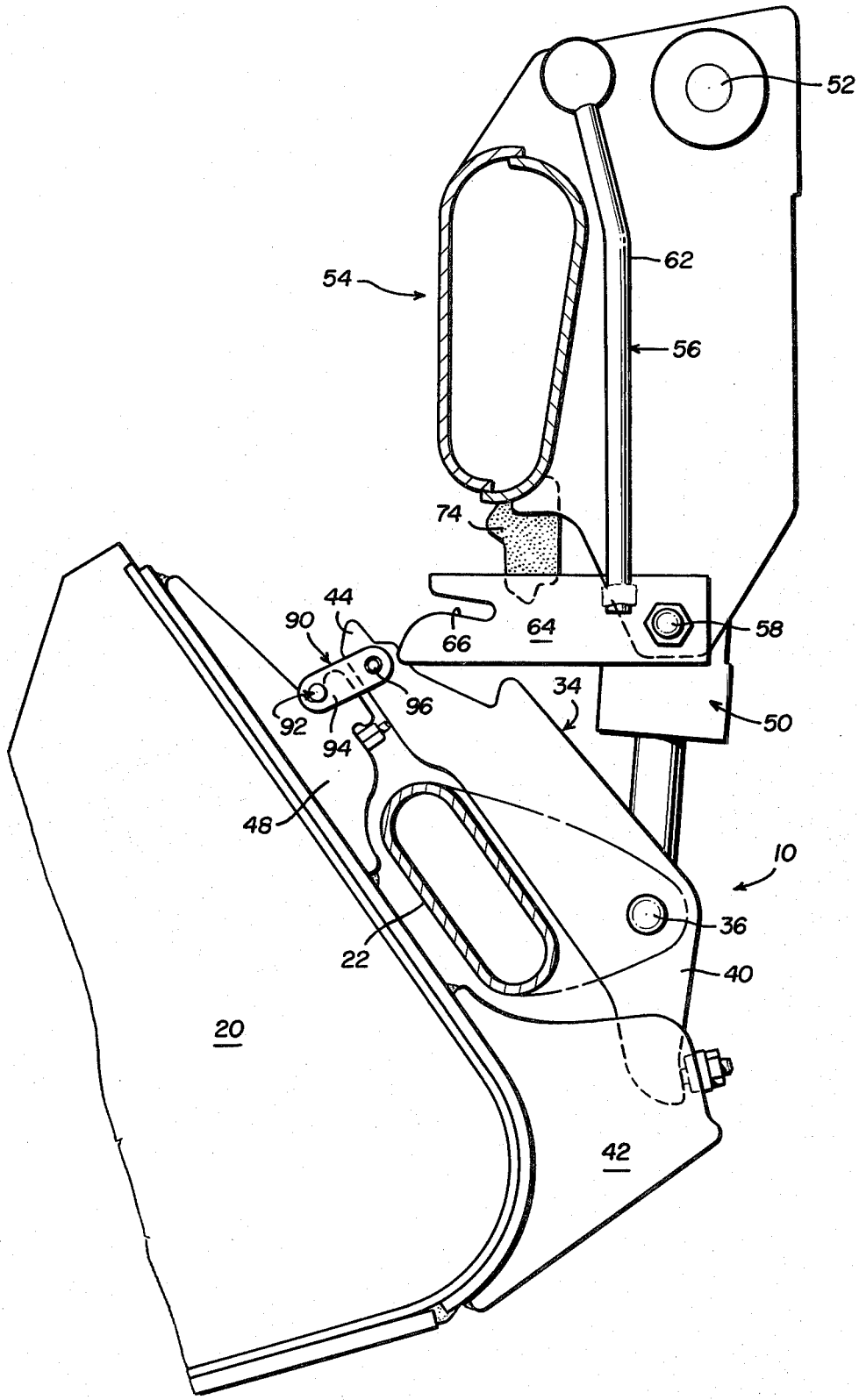
FIG. 10 is a cross-sectional view similar to FIG. 3 illustrating the quick coupler assembly of the present invention with a second embodiment of the latching mechanism.
Figure 14:
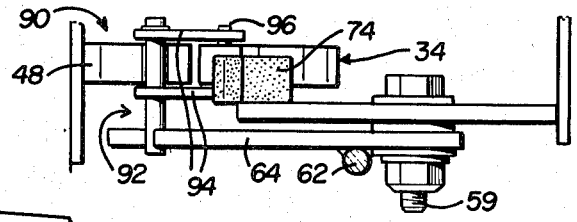
FIG. 14 is a top plan view of the assembly shown in FIG. 13.

Lock pin 70 is moved into a final seated or locked position within locking hooks 48 by moving the handle portion 62 of lock lever 56 to the left side of handle stop 72 as viewed in FIG. 3 which also permits attaching lever 34 to move away from the position shown in FIG. 9 without interference. Then, bucket 20 is coupled to quick coupler 10, and it may be rotated to any desired position by extending or retracting tilt cylinder 50.

Figure 2:
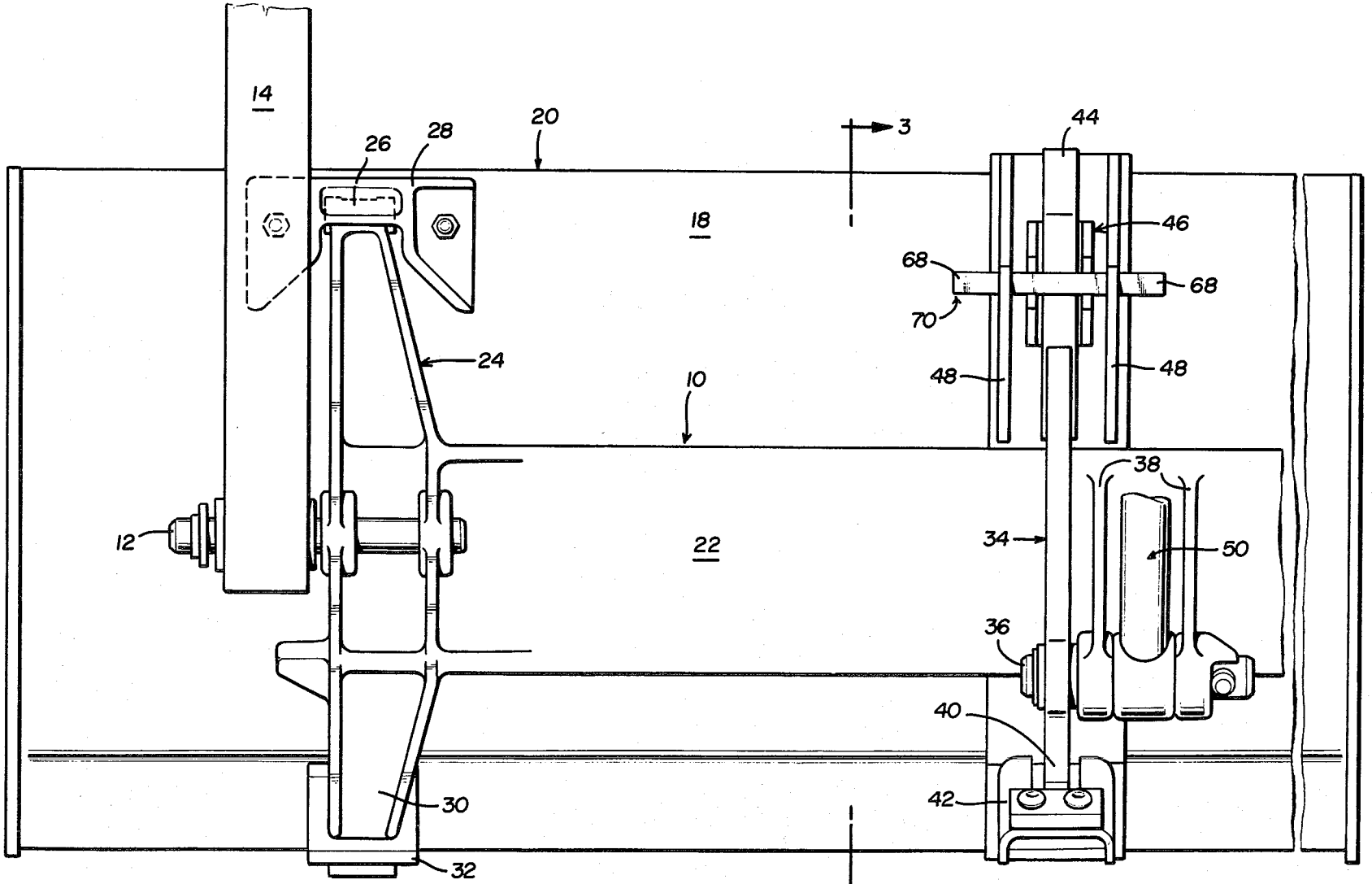
FIG. 2 is a rear view of the quick coupler assembly of FIG. 1 attached to a bucket.

FIGS. 2–4 illustrate bucket 20 connected to quick coupler 10 as hereinbefore described. Bucket 20 is uncoupled from quick coupler 10 by performing the coupling steps in reverse. Referring to FIG. 5, bucket 20 is rotated rearwardly until the upper end 44 of attaching lever 34 engages stop member 74 and the ends 68 of lock pin 70 move into lock pin receiving portions 66. The operator then moves lock lever handle portion 62 to the right side of handle stop 72 (as viewed in FIG. 3) which causes upward sliding movement of bracket assembly 46 and lock pin 70 on attaching lever end portion 44 thereby unlocking attaching lever 34 from bucket 20. Bucket 20 is then left hanging on hitch brackets 24 as previously described for easy uncoupling and bracket assembly 46 is held near stop member 74 by lock lever 56.

A second embodiment of the quick coupler assembly 10 is illustrated in FIGS. 10–14, but it differs from the first embodiment only in the type of latching mechanism used. Further, while certain elements of the assembly have a slightly different shape from that shown in FIGS 1–9, their operation and function is identical to that previously described. Thus, the same numbers have been used to identify those elements whose operation and function is identical to that previously described.

Figure 11:
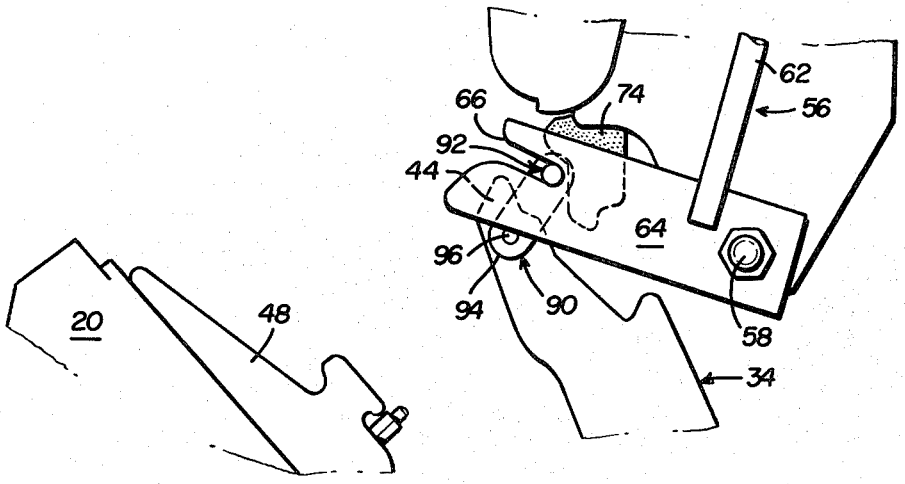
FIG. 11 is a fragmentary side elevational view illustrating the rotatable locking bracket assembly on the attaching lever with the attaching lever being in its unlocked condition.

The locking bracket assembly 90 shown in FIGS. 10–14 includes a lock pin 92 which is rotatably connected to attaching lever 34 by links 94 and pin 96. As shown in FIG. 11, the pin receiving portion 66 of lock lever leg 64 holds lock pin 92 and attaching lever 34 near stop 74 when bucket 20 is unlatched from coupler assembly 10. Attaching lever 34 is held in the position shown in FIG. 11 until bucket 20 is rotated rearwardly by tilt cylinder 50 thereby pushing attaching lever 34 back against stop member 74.

Figure 13:
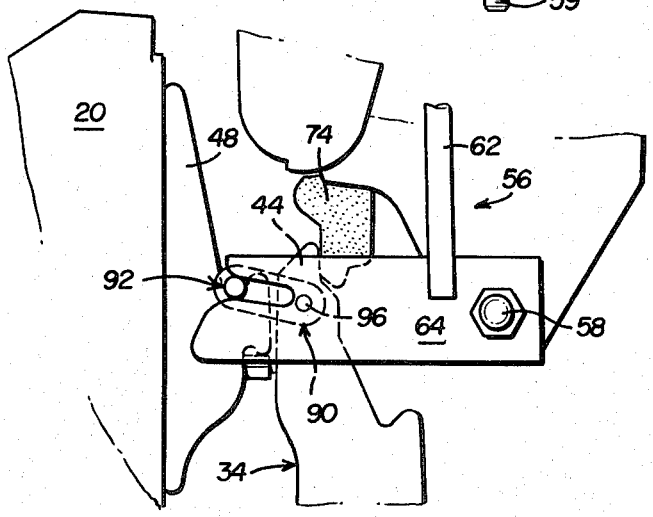
FIG. 13 is a fragmentary side elevational view illustrating the rotatable locking bracket assembly in its locked condition.
Figure 12:
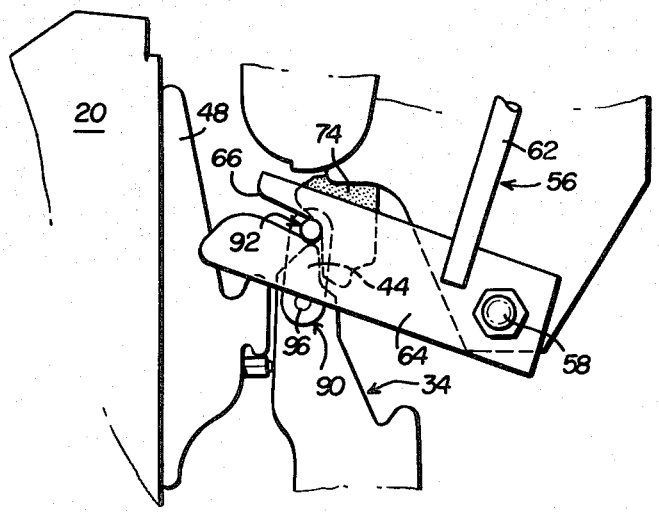
FIG. 12 is a fragmentary side elevational view illustrating the position of the rotatable locking bracket assembly just prior to locking.

After the operator has located bucket 20 in the hanging position of FIG. 11 as previously described, tilt cylinder 50 is extended to rotate bucket 20 rearwardly toward stop member 74 and against attaching lever 34. As shown in FIG. 12, the upper end 44 of attaching lever 34 is pushed against stop member 74 in response to rearward rotation of bucket 20. After bucket 20 has been pressed into engagement with attaching lever 34 by tilt cylinder 50, lock pin 92 is moved into a final seated or locked position within locking member 48 by rotating handle portion 62 of lock lever 56 as illustrated in FIG. 13. Then, bucket 20 is coupled to quick coupler 10, and it may be rotated to any desired position by extending or retracting tilt cylinder 50. Bucket 20 is uncoupled from attaching lever 34 and locking bracket assembly 90 by performing the coupling steps in reverse.

It will be apparent to those skilled in the art that the foregoing disclosure is exemplary in nature rather than limiting, the invention being limited only by the appended claims.

We claim:

1. A quick coupler assembly for attaching a material handling bucket to the free ends of lift arms extending from a tractor loader, said quick coupler assembly including an elongated cross member pivotally connected to said lift arms, said cross member having hitch members mounted on its opposite ends, each hitch member including an upper end which is movable into engagement with an upper coupling member on said bucket near the top edge thereof, the opposite end of each hitch member being configured for engagement with a lower coupling member on said bucket, said coupler assembly further including an attaching lever which is rotatably secured substantially at the mid-portion of said cross member, one end of said attaching lever being movable into engagement with a coupling member on said bucket, the opposite end of said attaching lever including a movable locking bracket assembly which is selectively positioned into locking engagement with a locking member on said bucket, a tilt cylinder for rotating and preloading said bucket against said coupler assembly before said locking bracket assembly is positioned into locking engagement with said locking member.

2. The quick coupler assembly as defined in claim 1 wherein said locking bracket assembly includes a lock pin which is movable into locking engagement with said locking member, a manually operable lock lever pivotally attached to a frame assembly, said lock lever including a handle portion and at least one leg having a lock pin receiving portion for releasably holding an end of said lock pin, said lock lever being movable to a first position for holding said attaching lever near a stop member on said frame assembly and said lock lever being movable to a second position for seating said lock pin against said locking member while simultaneously permitting said attaching lever to move away from said stop member without interference.

3. The quick coupler assembly as defined in claim 1 wherein said locking bracket assembly includes a lock pin which is rotatably connected to said attaching lever.

4. The quick coupler assembly as defined in claim 1 wherein said locking bracket assembly includes a lock pin which is slidably connected to said attaching lever.

5. A quick coupler assembly for attaching a material handling bucket to the free ends of lift arms extending from a tractor loader, said quick coupler assembly including an elongated cross member pivotally connected to said lift arms, said cross member having hitch members mounted on its opposite ends, each hitch member including upper and lower ends which are movable into engagement with said bucket, said coupler assembly further including an attaching lever which is rotatably secured adjacent to said cross member, one end of said attaching lever including a movable locking bracket assembly which is selectively positioned into locking engagement with a locking member on said bucket, and a tilt cylinder for rotating and preloading said bucket against said attaching lever before said locking bracket assembly is positioned into locking engagement with said locking member, said locking bracket assembly including a lock pin which is movable into locking engagement with said locking member, a manually operable lock lever pivotally attached to a frame assembly, said lock lever including a handle portion and at least one leg having a lock pin receiving portion for releasably holding an end of said lock pin, said lock lever being movable to a first position for holding said attaching lever and lock pin near a stop member on said frame assembly and said lock lever being movable to a second position for seating said lock pin against said locking member while simultaneously permitting said attaching lever to move away from said stop member without interference, and said attaching lever being movable against said stop member in response to said tilt cylinder rotating said bucket against said attaching lever.

* * * * *